United States Patent [19]

Quarderer et al.

[11] 4,102,775

[45] Jul. 25, 1978

[54] CONVERSION PROCESS FOR SOLID, HYDROCARBONACEOUS MATERIALS

[75] Inventors: George J. Quarderer, Midland; Norman G. Moll, Sanford, both of Mich.

[73] Assignee: The Dow Chemical Company, Midland, Mich.

[21] Appl. No.: 824,770

[22] Filed: Aug. 15, 1977

[51] Int. Cl.[2] ..... C10G 1/08

[52] U.S. Cl. ..... 208/10

[58] Field of Search ..... 208/8, 10

[56] References Cited

U.S. PATENT DOCUMENTS

| | | | |
|---|---|---|---|
| 2,860,101 | 11/1958 | Pelipetz | 208/10 |
| 3,162,594 | 12/1964 | Gorin | 208/57 |
| 3,532,617 | 10/1970 | Hodgson | 208/10 |
| 3,856,675 | 11/1972 | Sze et al. | 208/10 |

*Primary Examiner*—Delbert E. Gantz
*Assistant Examiner*—J. Thierstein
*Attorney, Agent, or Firm*—G. R. Plotecher

[57] ABSTRACT

Solid, hydrocarbonaceous materials, such as coal, are converted to valuable liquid and gaseous products by an efficient process comprising:

(1) preparing a slurry from slurry oil, a hydrogenation catalyst and the hydrocarbonaceous material;

(2) hydrogenating the hydrocarbonaceous material to liquid and gaseous hydrogenation products, the liquid hydrogenation product containing suspended particles of ash and catalyst;

(3) gravitationally separating the liquid hydrogenation product into a first stream and a second stream, the first stream having both a lower ash concentration than the liquid hydrogenation product and a greater catalyst:ash ratio than the second stream;

(4) recycling at least a portion of the first stream for use as at least a portion of the slurry oil and thereby recycling at least a portion of the catalyst.

This process is characterized by an economical, highly effective catalyst system, sequential gravitational and extractive solids separations for the generation and recycle of slurry oil, and low-ash fuel and chemical feedstock manufacture.

9 Claims, 5 Drawing Figures

CONVERSION PROCESS FOR SOLID, HYDROCARBONACEOUS MATERIALS

BACKGROUND OF THE INVENTION

1. Field of the Invention

This invention relates to the conversion of a solid, hydrocarbonaceous material to valuable products. In one aspect, the invention relates to the liquefaction of coal while in another aspect it relates to the production of high-grade fuel and valuable chemical feedstocks.

2. Description of the Prior Art

The art is replete with processes for converting solid, hydrocarbonaceous materials, such as coal, to mixtures of gaseous and liquid products. The Synthoil process, developed at the U.S. Bureau of Mines and described by Yavorsky et al. in *Chem. Eng. Progress,* 69, (3), 51-2 (1973), the H-Coal process, developed by Hydrocarbon Research, Inc. and described in a series of patents including Johanson, U.S. Pat. No. Re 25,770, Schuman et al., U.S. Pat. No. 3,321,393 and Wolk et al., U.S. Pat. No. 3,338,820, and the Solvent-Refined Coal (SRC) processes I and II developed by the Gulf Mineral Resources Co. and described in "Recycle SRC Prcessing for Liquid and Solid Fuels", presented at *4th Int. Conf. on Coal Gasification, Liquefaction and Conversion to Electricity,* Univ. of Pittsburgh (Aug. 2–4, 1977), are representative. The Synthoil and H-Coal processes are generally characterized by a fixed or ebullated catalytic bed. While these and similar art processes are generally effective for their intended purpose, they do have inherent features that are generally considered undesirable from the perspectives of efficiency and convenience. For example, the art processes frequently require specially designed equipment, incur extensive down-time for removal of spent catalyst followed by reloading and pretreating fresh catalyst, suffer deactivation of the catalyst by components of the feed material, incur loss of catalyst fines to the process product, suffer occlusion of the catalyst by the feed material and incur caking or plugging of the process equipment by catalyst particles.

Since the SRC I process is noncatalytic and the SRC II process is pseudocatalytic (ash is recycled to enhance coal conversion), these processes generally avoid the inherent deficiencies of catalytic systems. However, both SRC I and II report relatively low feed throughputs.

SUMMARY OF THE INVENTION

According to this invention, solid, hydrocarbonaceous material is efficiently and conveniently converted to valuable gaseous and liquid products by a process comprising:

(a) preparing a slurry from a slurry oil, a hydrogenation catalyst and the hydrocarbonaceous material;

(b) admixing hydrogen with the slurry;

(c) hydrogenating the hydrocarbonaceous material to liquid and gaseous hydrogenation products, the liquid hydrogenation product containing suspended particles of ash and hydrogenation catalyst;

(d) gravitationally separating the liquid hydrogenation product into a first stream and a second stream, the first stream having both a lower ash concentration than the liquid hydrogenation product and a greater catalyst:ash ratio than the second stream;

(e) recycling at least a portion of the first stream for use as at least a portion of the slurry oil in the slurry preparation and thereby recycling at least a portion of the catalyst;

(f) extractively separating the second stream into a third stream and a fourth stream, the third stream containing essentially no ash and the fourth stream containing essentially all of the ash of the second stream;

(g) recycling at least a portion of the third stream for use as at least a portion of the slurry oil in the slurry preparation; and (h) recovering valuable liquid and gaseous products from the hydrogenation products.

Advantages of this invention include an efficient and convenient catalyst system, relatively high feed (slurry) throughputs, and overall flexibility and feedback control to permit ready recovery from process upsets or response to changes in feed quality.

In a preferred embodiment for the liquefaction of coal, the invention employs an expendable, in situ-formed hydrogenation catalyst, hydroclones for separating the liquid hydrogenation product and a countercurrent, liquid-liquid extractor (deasphalter) for separating the second stream. The expendable catalyst avoids the problems of deactivation, costly process interruptions for replacement and the general operation complexity associated with fixed- and ebullated-bed reactors. The hydroclones are inexpensive, durable and simple-to-use solid separators which provide a ready means for slurry oil and catalyst recycle. The deasphalter produces a high-grade fuel oil, a part of which is recycled as slurry oil and a high-ash residue suitable as a gasification feedstock.

DESCRIPTION OF THE DRAWINGS

Apparatus

The drawings are schematic flow diagrams illustrating a specific embodiment of the invention as applied to the liquefaction of coal.

Like numerals are employed to designate like parts throughout the drawings and various items of equipment, such as valves, fittings, pumps, condensers, holding tanks, feed tanks, scrubbers and the like, have been omitted from the drawings so as to simplify the description of the invention. However, those skilled in the art will recognize that such conventional equipment can be employed as desired.

Figure 1:
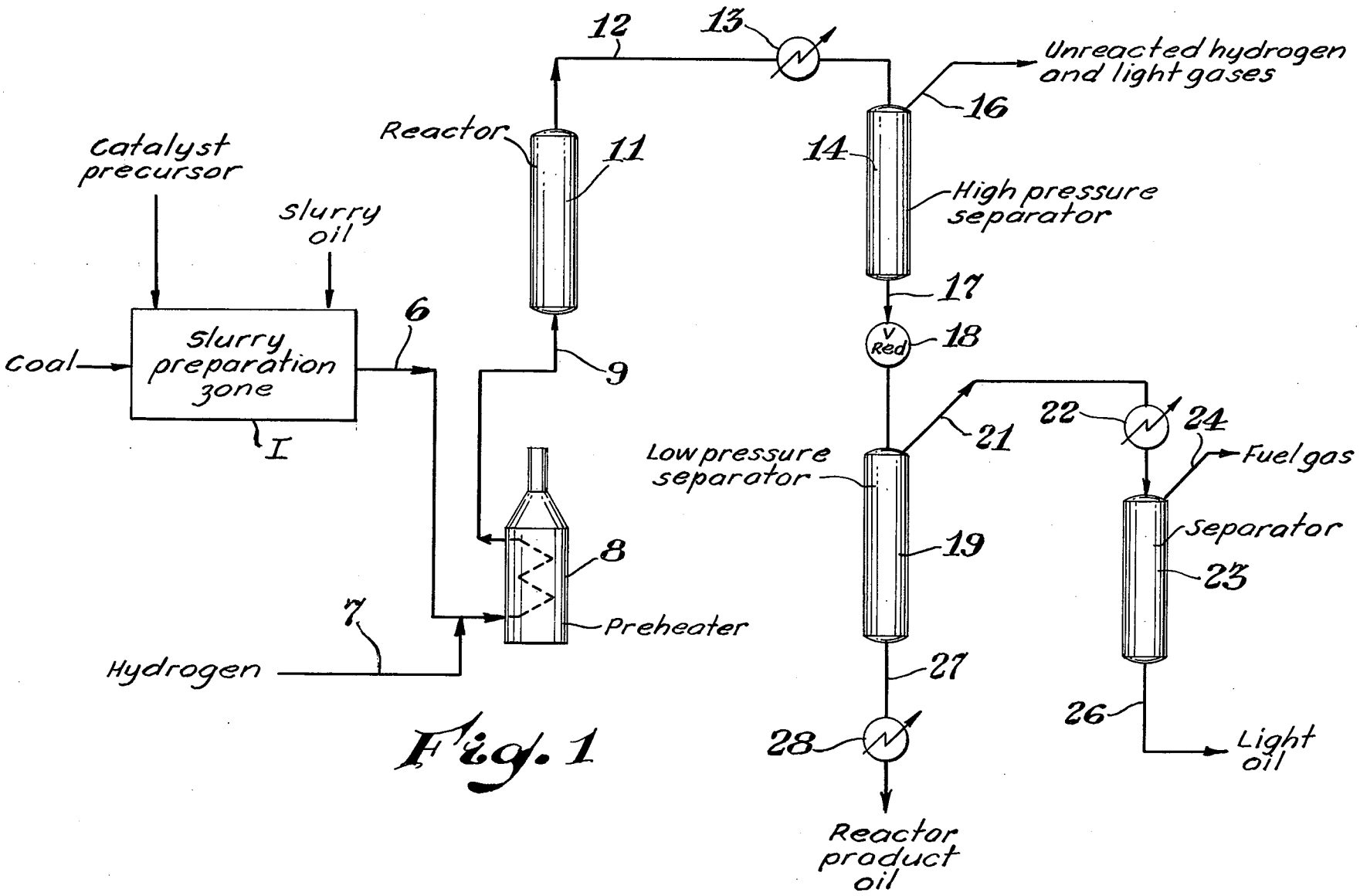
FIG. 1 is a schematic flow diagram illustrating a preferred slurry preparation and coal hydrogenation embodiment of this invention.

In FIG. 1, area I represents a slurry preparation zone to which coal, catalyst precursor and slurry oil are charged. Area I is joined to a preheater 8 by a conduit 6. An entry conduit 7 mates with conduit 6 at any convenient point along the length of conduit 6. A conduit 9 joins preheater 8 with a reactor 11 and a conduit 12 joins reactor 11 with a high pressure separator 14. A heat exchange unit 13 is disposed at any convenient point along the length of conduit 12. Separator 14 is equipped with an exit conduit 16 and a conduit 17, the latter of which joins separator 14 to a low pressure separator 19. A pressure reduction valve 18 is disposed at any convenient point along the length of conduit 17. A conduit 21 joins separator 19 with a separator 23 and conduit 21 has a heat exchange unit 22 disposed at any convenient point along its length. Separator 23 is equipped with exit conduits 24 and 26. Separator 19 is equipped with conduit 27 which has a heat exchange unit 28 disposed at any convenient point along its length.

Figure 2:
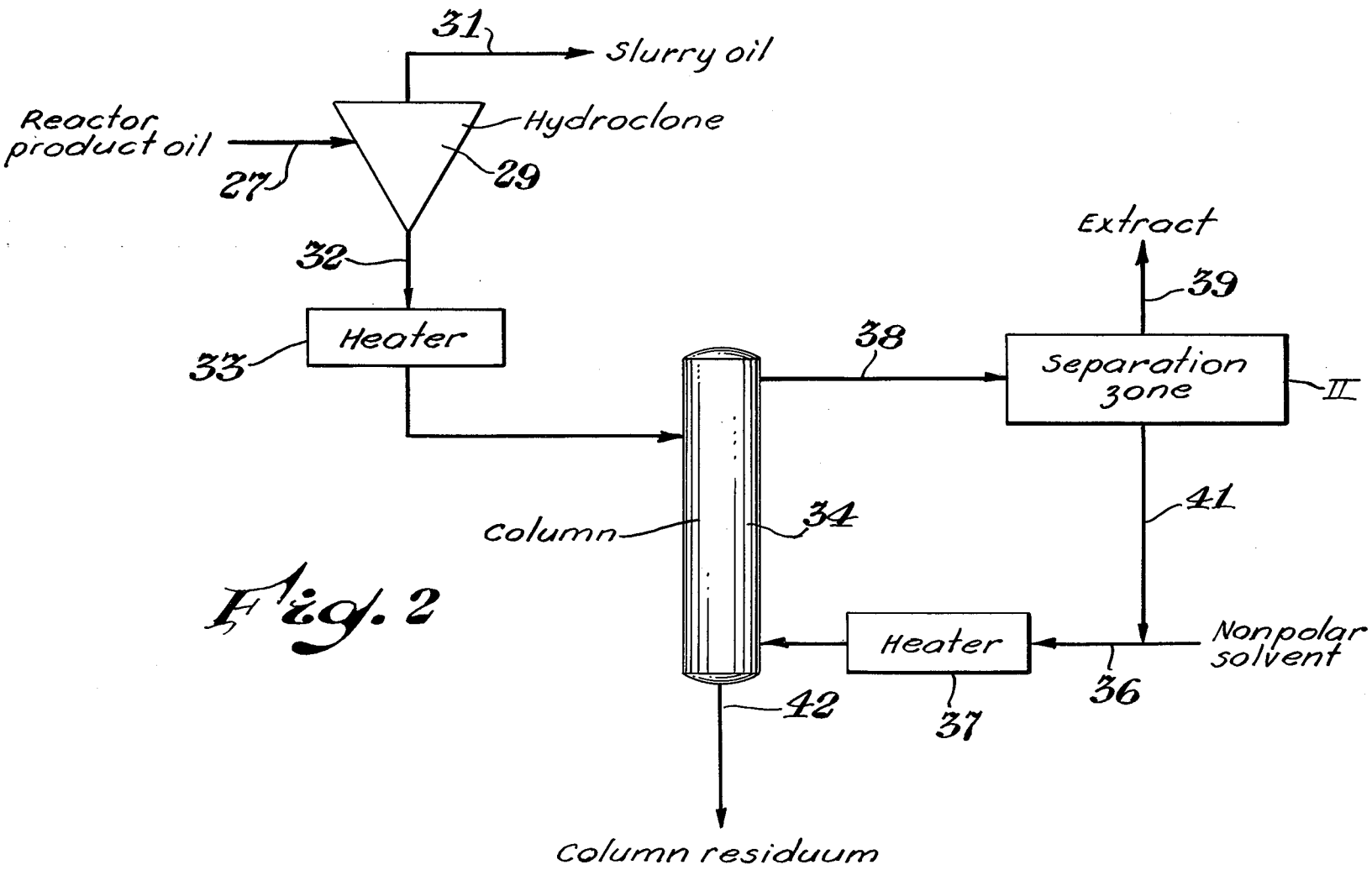
FIG. 2 is a schematic flow diagram illustrating a preferred liquid hydrogenation product separation, recycle and ash removal embodiment of this invention.

Referring now to FIG. 2, conduit 27 connects separator 19 of FIG. 1 with a hydroclone 29, the latter equipped with an exit conduit 31 and a conduit 32. Conduit 32 has a heater 33 disposed at any convenient point along its length and conduit 32 joins hydroclone 29 with a vertical column 34. Column 34 is equipped with a conduit 42, is connected with an entry conduit 36 which has a heater 37 disposed at any convenient point along its length, and is connected with a separation zone II by a conduit 38. An exit conduit 39 and a conduit 41 proceed from separation zone II and conduits 41 and 36 mate with each other at any convenient point along the length of conduit 36 but prior to heater 37.

Figure 3:
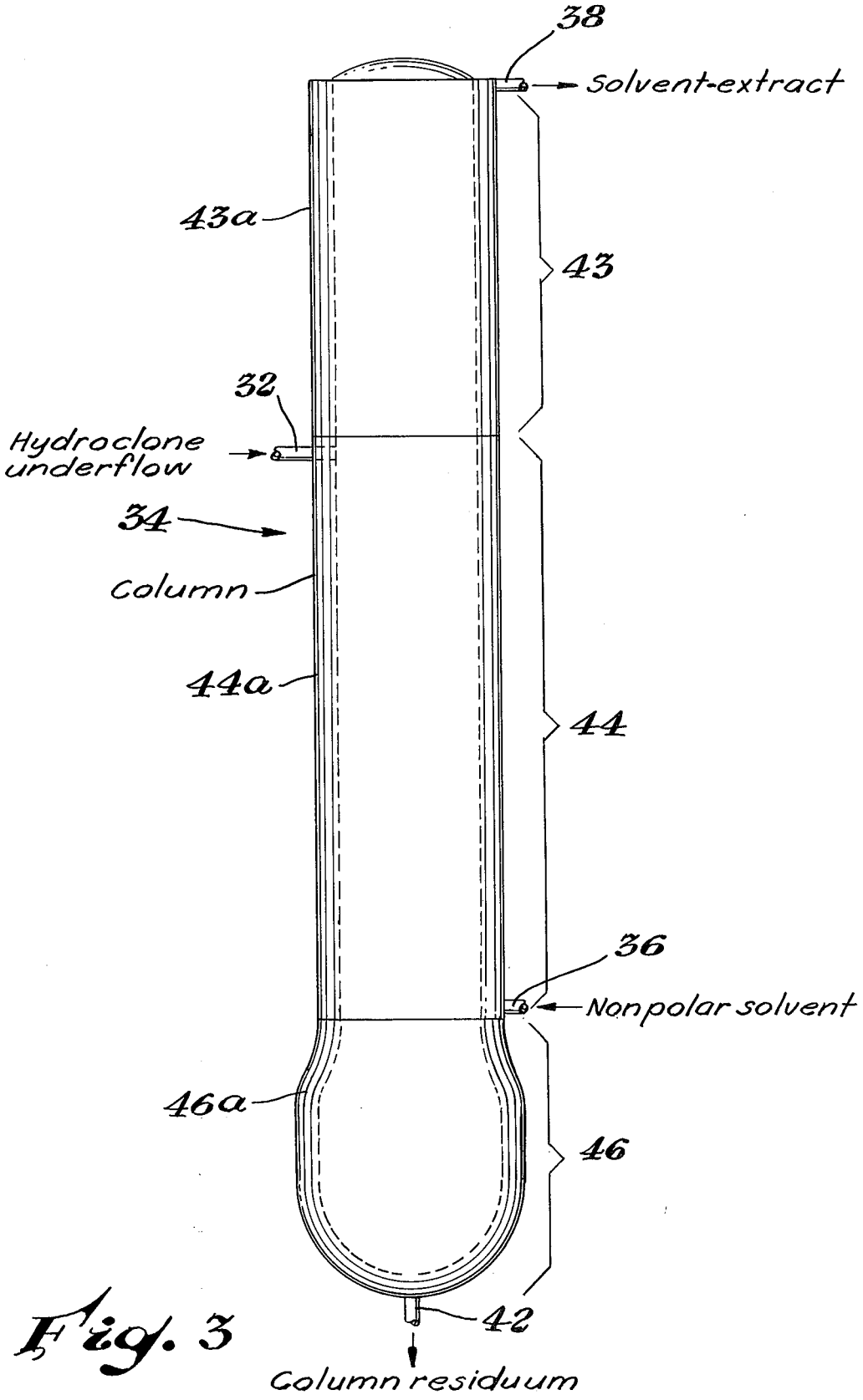
FIG. 3 is a preferred embodiment of the FIG. 2 vertical column 34.

Referring now to FIG. 3, vertical column 34 consists of a first or solvent-extract mixture collection zone 43, a second or gradient separation zone 44, and a third or residual hydroclone underflow settling zone 46. Zone 43 is equipped with a thermal jacket **43*a* and connects with conduit 38. Zone 44 is equipped with a thermal jacket 44*a* and connects with conduits 32 and 36. Zone 46 is equipped with both a thermal jacket 46*a* and exit conduit 42**.

Figure 4:
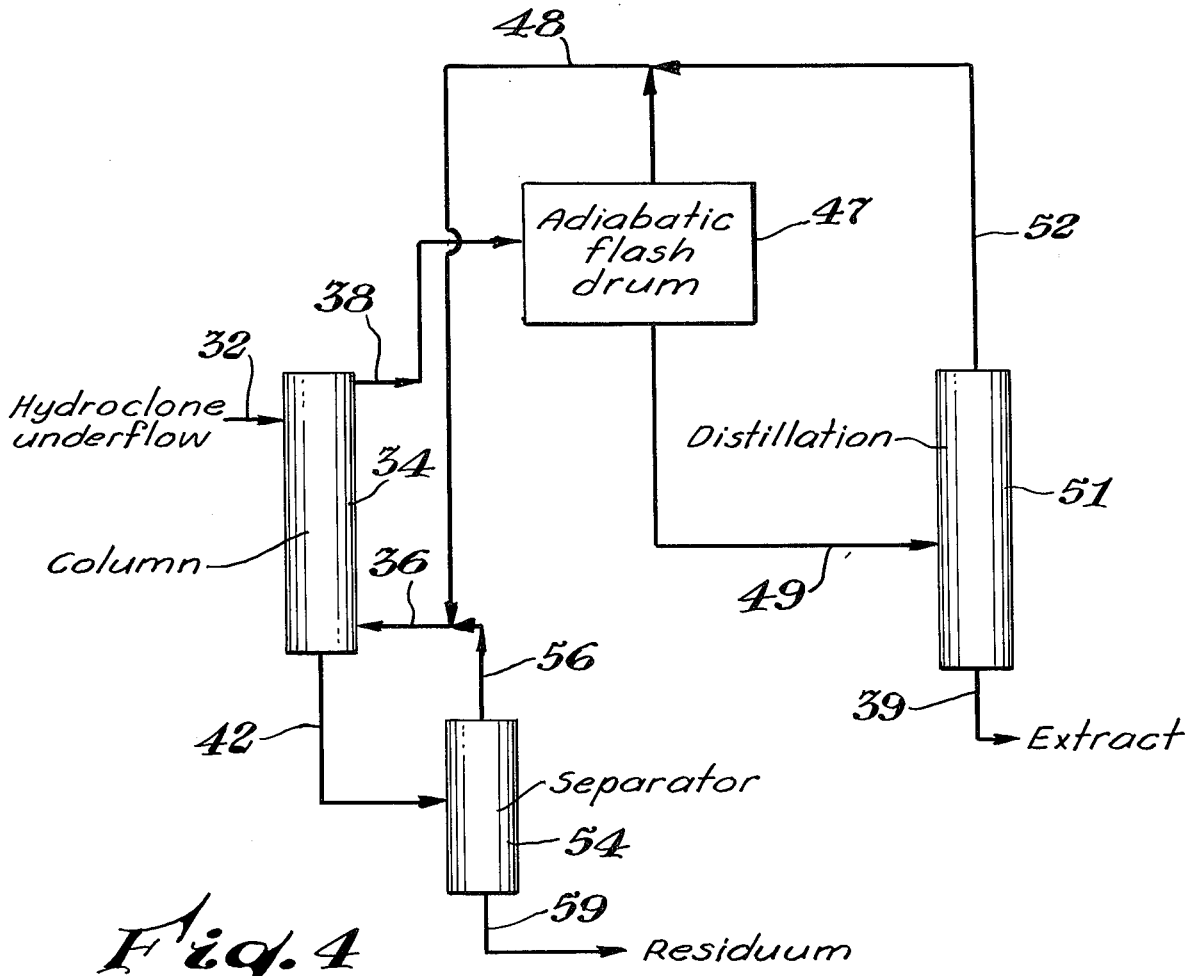
FIG. 4 is a preferred embodiment of the FIG. 2 separation zone II.

Referring now to FIG. 4, column 34 is connected to an adiabatic flash drum 47 by conduit 38 and mated conduits 48 and 36. A distillation unit 51 equipped with an exit conduit 39 is joined to both flash 47 by a conduit 49 and to column 34 by mated conduits 52, 48 and 36. A separator, e.g., adiabatic flash, 54 is connected to column 34 by conduit 42. An exit conduit 59 proceeds from separator 54 and mated conduits 56 and 36 join separator 54 with column 34.

Figure 5:
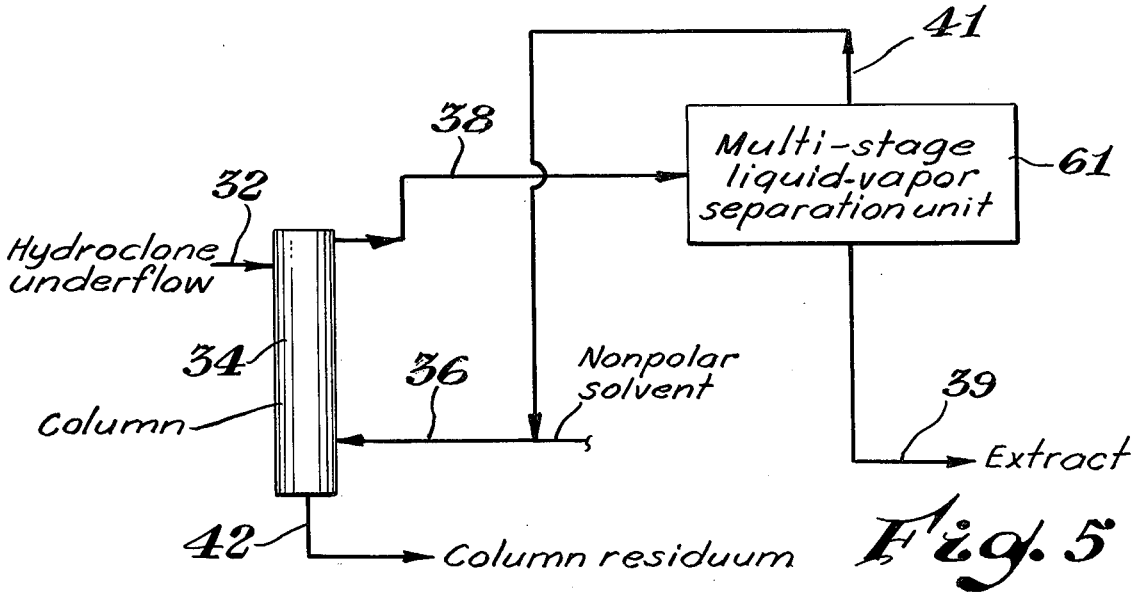
FIG. 5 is another preferred embodiment of the FIG. 2 separation zone II.

Referring now to FIG. 5, a multi-stage liquid-vapor separation unit 61 replaces flash 47 and distillation unit 51 of FIG. 4. Unit 61 is connected to column 34 by conduit 38 and mated conduits 41 and 36, and is equipped with exit conduit 39.

Process Sequence

In the described apparatus of FIGS. 1–5, slurry oil, catalyst precursor and crushed, dried, pulverized and classified coal are charged to the slurry preparation zone I of FIG. 1. Slurry is prepared and then passed through conduit 6 to preheater 8. Hydrogen, introduced through conduit 7, is admixed with the slurry within conduit 6. The resulting slurry-hydrogen mixture is then heated to a threshold hydrogenation temperature as it passes through preheater 8 and is subsequently passed through conduit 9 to reactor 11.

Although some coal hydrogenation occurs in preheater 8, the major coal hydrogenation occurs in reactor 11. A three-phase (gas, liquid and solid) hydrogenation product passes from reactor 11 to high pressure separator 14 through conduit 12 and heat exchanger 13. Unreacted hydrogen and light gases are removed from separator 14 through exit conduit 16 and the remaining hydrogenation product passes through conduit 17 to low pressure separator 19 after having undergone a pressure reduction via valve 18. Liquefied petroleum gases (LPG's) or fuel gas, water vapor and light oil are removed from separator 19 through conduit 21 and heat exchanger 22 to separator 23. The LPG's and water vapor are removed from separtor 23 through exit conduit 24 while light oil is removed through exit conduit 26. The underflow, i.e., liquid hydrogenation product or reactor product oil, from separator 19 comprises ash, unreacted coal, asphaltenes (that portion of the product that is toluene soluble and hexane insoluble as described in the Analytical Procedures hereinafter set forth), distillable oil (oil having a distillation temperature in excess of about 150° C) and catalyst (converted catalyst precursors). This underflow passes through conduit 27 and heat exchanger 28 to hydroclone 29 (FIG. 2).

Referring now to FIG. 2, the underflow from separator 19 is gravitationally separated by hydroclone 29 into an overflow or first stream removed through conduit 31 and an underflow or second stream removed through conduit 32. The overflow removed through conduit 31 has both a lower ash concentration than separator 19 underflow and a greater catalyst:ash ratio than hydroclone 29 underflow, i.e., the overflow has a reduced ash level; at least a portion of hydroclone 29 overflow is recycled to slurry preparation zone I (FIG. 1) for use as a slurry oil component. Hydroclone 29 underflow comprises concentrated ash, unconverted coal and product oil (oil having a distillation temperature in excess of 150° C) and is charged to column 34 after passing through heater 33. This hydroclone underflow (or now column 34 feed) is extractively separated within column 34 into a third stream or column 34 overflow and a fourth stream or column 34 underflow or residuum by countercurrently contacting it (hydroclone 29 underflow) with a liquid, nonpolar solvent, the latter charged to column 34 through conduit 36 and heater 37. The nonpolar solvent extracts from hydroclone 29 underflow an extract comprising that portion of the underflow soluble in the nonpolar solvent at the column operating conditions and the nonpolar solvent and extract is removed from column 34 as overflow through conduit 38 to separation zone II. Within separation zone II, column 34 overflow is separated into the extract which is removed through exit conduit 39 and the nonpolar solvent which is removed and recycled through mated conduits 41 and 36 to column 34. At least a portion of the extract is recycled (not pictured) to slurry preparation zone I (FIG. 1) for use as a slurry oil component. Column 34 underflow or residuum is a viscous slurry comprising ash and polar liquids (generally asphaltenes and toluene insolubles) and is removed through conduit 42 to any of a number of different utilities, such as gasification, pyrolysis, etc.

Further describing the operation of column 34, and referring now to FIG. 3, hydroclone 29 underflow is continuously charged to column 34 through conduit 32 and heater 33 while a liquid, nonpolar solvent is simultaneously and continuously charged to column 34 through conduit 36 and heater 37. The solvent passes up and through zone 44 while hydroclone 29 underflow simultaneously passes down and through zone 44. During this continuous, simultaneous passing, the solvent and underflow are in intimate contact and the solvent extracts from the underflow an extract comprising that portion of the underflow which is soluble in the solvent at the column (and particularly zone 44) conditions.

The solvent and extract are continuously collected in zone 43 and removed from column 34 through conduit 38. A column residuum, i.e., the underflow minus the extract, is continuously collected in zone 46 and removed from column 34 through conduit 42.

Now referring to and describing the operation of the FIG. 4 preferred embodiment of separation zone II, the solvent-extract mixture collected in zone 43 of column 34 (FIG. 3) is removed as column 34 overflow and is passed through conduit 38 to flash drum 47 where at least a portion of the solvent is removed from the extract and recycled to column 34 through mated conduits 48 and 36. The remaining solvent-extract mixture is transferred through conduit 49 to distillation unit 51 where the remaining solvent is distilled overhead and recycled through mated conduits 52, 48 and 36 to column 34 while the extract is removed as an underflow through exit conduit 39.

Column 34 residuum collected in zone 46 (FIG. 3) is removed through conduit 42 to separator, e.g., adiabatic flash, 54. Separator 54 recovers any solvent present in this residuum and recycles it through mated conduits 56 and 36 to column 34. The remaining residuum is removed through conduit 59.

Now referring to and describing the operation of the FIG. 5 preferred embodiment of separation zone II, the overflow from column 34 is transferred through conduit 38 to multi-stage, liquid-vapor separation unit 61. Here the solvent is separated from the extract and recycled through mated conduits 41 and 36 to column 34, while the extract is removed through exit conduit 39. The choice between unit 61 and the combination of FIG. 4 units 47 and 51 is governed by the needs of the individual practitioner.

DETAILED DESCRIPTION OF THE INVENTION

I. The Slurry

A. Hydrocarbonaceous Material

Any solid, hydrocarbonaceous material that can be catalytically hydrogenated while suspended in a slurry oil can be used in the practice of this invention. Typical materials include: coal (e.g., anthracite, bituminous, sub-bituminous), lignite, peat and various combinations thereof. Coal is preferred to lignite and peat, and bituminous and sub-bituminous are the preferred coals. Prior to being introduced into the slurry preparation zone, the material is sequentially crushed, dried, pulverized and classified. The material is crushed to a size generally less than a quarter inch in the three dimensions and then dried to about a one weight percent water content, the latter being an aid to pulverization. After drying, the material is pulverized under an inert atmosphere, such as nitrogen, to prevent oxidation and possible deflagration. Finally, the pulverized material is classified such that the material charged to the slurry preparation zone is compatible with the process pumps.

B. Slurry Oil

The slurry oil here used comprises a blend of the first stream produced from the gravitational separation of the liquid hydrogenation product and the third stream produced from the extractive separation of the second stream, e.g., a blend of hydroclone 29 and column 34 overflows. The relative amounts of the first and third streams in the blend can vary to convenience, i.e., the composition of the blend can vary from about 1 weight percent first stream and about 99 weight percent third stream to about 99 weight percent first stream and about 1 weight percent third stream, but the first stream preferably comprises at least about 50, and more preferably at least about 70, weight percent of the blend with the third stream constituting the remainder of the blend. The first and third streams can be blended in any conventional manner and at any convenient time. Typically, the blend is essentially water-immiscible and has had at least a portion of any low-boiling first and third stream components removed before being used to slurry hydrocarbonaceous material.

In addition to the blend, the slurry oil can comprise other components, such as known coal liquefaction start-up oils. Of course, until recycle of at least a portion of the first and third streams have been established, these other components constitute the slurry oil. However, once this recycle has been established, other components are gradually phased from the process until the blend constitutes the slurry oil.

Sufficient slurry oil is combined with the hydrocarbonaceous material to provide a pumpable slurry. In coal liquefaction, the typical minimum concentration of coal in the slurry (based on weight) is about 10 percent and preferably about 20 percent. The typical maximum coal concentration is about 45 percent and preferably about 43 percent. Most preferably, the coal concentration in the slurry is between about 38 and 42 percent.

C. Catalyst

As here used, "hydrogenation catalyst" includes both active hydrogenation catalysts and hydrogenation catalyst precursors. The hydrogenation catalysts here used are well known and require little elaboration. They are generally metal-containing compounds and are either impregnated into and/or coated onto the hydrocarbonaceous material or dispersed within the slurry oil prior to hydrogenation. A small but sufficient amount of catalyst is used to promote the hydrogenation of the hydrocarbonaceous material and these amounts, which can vary with process parameters, are also well known in the art.

In a preferred embodiment of this invention, a metal-containing hydrogenation catalyst is conveniently introduced into and efficiently dispersed in the slurry oil by initially adding it as an emulsion of a water solution of a compound of the metal in the liquid phase, the metal compound being convertible to the active hydrogenation catalyst under hydrogenation conditions, i.e., the dissolved metal compound (catalyst precursor) is decomposed and converted to an active form of the metal catalyst, probably a sulfide. The active catalyst is thereby formed in situ as microscopically fine particles dispersed in the liquid reaction mixture.

The water-soluble salt of the catalytic metal can be essentially any such salt. Metal catalysts, such as those of the iron group, tin or zinc, the nitrate or acetate may be most convenient whereas for molybdenum, tungsten or vanadium, more complex salts, such as an alkali metal or ammonium molybdate, tungstate or vanadate may be preferable. The salts may be used either singly or in combination with one another.

The quantity of catalysts used in this embodiment can be significantly less than the quantities preferred in the prior art processes because of the better dispersion provided throughout the reaction mixture. In coal liquefaction, a minimum of about 0.005 weight percent molybdenum (in the form of ammonium or alkali metal heptamolybdate), based on coal, and preferably about 0.01 weight percent, is sufficient. Practical considerations, such as economy, convenience, etc., are the only limitations upon the maximum weight percent of catalysts here used but a typical maximum is generally about 1 weight percent and preferably about 0.5 weight percent. The prior art processes, such as Synthoil and H-Coal, commonly employ greater amounts of catalysts. Similar low proportions of other hydrogenation catalysts are also effective in this invention, although less active catalysts, such as iron, may require somewhat higher proportions, such as a minimum of about 1 weight percent. However, the proportion of catalysts in the reaction mixture is a variable which affects the product distribution and degree of conversion. Normally, relatively high proportions of catalysts result in higher conversion and also higher yields of gases and light oil. Smaller proportions of catalysts made possible by this embodiment with better catalyst dispersion, can provide high conversion and high yields of higher boiling oil. The convenient mode of catalyst addition and broad applicability of the method are other advantages of this particular embodiment.

The proportions of metal compound to water and of water solution to emulsifying oil have a significant effect on the characteristics of the catalysts. Typical emulsifying oils include oils having a distillation temperature in excess of 150° C generally, and the first stream, e.g., hydroclone overflow, specifically. Good results are obtained when a concentrated aqueous solution, e.g., about a 25 weight percent solution of ammonium heptamolybdate, is emulsified but generally a more active catalyst is formed when a relatively dilute solution, e.g., about a 5 weight percent solution of ammonium heptamolybdate, is used, probably because smaller particles of catalyst are produced. It is also desirable to maintain a high proportion of emulsifying oil to water solution in order to make a relatively stable emulsion of small aqueous droplets and consequently a finely dispersed catalyst. Since a liquid feed mixture is ordinarily passed to the hydrogenation process soon after being prepared with the emulsified catalyst solution, the emulsion does not have to be of a very high stability and the use of an emulsifier or emulsion stabilizer may not be necessary. In some systems, however, such an additive can be of advantage in facilitating the formation of an emulsion or in obtaining very small aqueous droplets in the emulsion. Any convenient method can be used to emulsify the salt solution in the hydrocarbon medium. To obtain the optimum fine dispersion of catalysts throughout the reaction mixture, it is important that the droplet size of aqueous phase in emulsion be very small. This condition can be achieved by initially forming a dispersion of oil in the aqueous solution, then causing the dispersion to reverse by slowly adding more oil so that the oil becomes the continuous phase and aqueous solution is very finely dispersed within it. Other methods of forming the emulsion have also given satisfactory results. The emulsion catalyst is further described in Applicants' copending application entitled "Emulsion Catalysts for Hydrogenation Processes", Ser. No. 772,874, filed Feb. 28, 1977.

In another coal liquefaction embodiment of this invention, a separate sulfiding step can be used to make a pulverized, metal catalyst more active. However, the smaller quantities of catalyst are effectively sulfided and activated during operation by the small amounts of sulfur normally present in coal and thus no specific catalyst sulfiding step is generally needed.

Since this invention uses relatively low levels of catalyst, the catalyst is considered expendable and the invention need not include a catalyst recovery step (although at least a portion of the catalyst is typically recycled). Other advantages derived from the small amounts of catalyst used include simpler reactor design and elimination of costly process interruptions for removal of catalyst deposits in process equipment.

D. Slurry Preparation

The slurry of this invention can be prepared in any conventional manner. The hydrocarbonaceous material can be admixed with the slurry oil and catalyst or vice versa or the hydrocarbonaceous material, slurry oil and catalyst can be admixed simultaneously. Preferably, catalyst is admixed with the slurry oil and the material is admixed with this admixture.

II. Hydrogen Addition

Hydrogen is generally admixed with the slurry after the addition of the catalyst but prior to the slurry's introduction into the preheater. However, the mode and timing of the hydrogen introduction is not critical and a fraction of the hydrogen can be directly introduced into the reactor. Hydrogen dispersion within the slurry is generally the result of slurry velocity and temperature but mechanical turbulence can be supplied if desired. A hydrogen-containing gas can be introduced at any rate sufficient to sustain the hydrogenation although a rate of at least about 20 SCF of hydrogen per pound of hydrocarbonaceous material is preferred.

III. Preheater

In a preferred embodiment, the hydrogen-containing slurry is generally passed through a preheater. The preheater, of any conventional design, heats the slurry to a temperature such that the slurry is at the threshold hydrogenation temperature prior to entering the reactor. Where the slurry comprises coal particles, particularly bituminous coal particles, the preheater heats the slurry to a temperature of at least about 375° C and preferably to a temperature of at least about 400° C. A temperature of about 420° C is most preferred. If the heat flux is not carefully controlled, thermodecomposition of the coal and slurry oil can occur causing preheater and downstream fouling and plugging.

IV. Reactor and Reactor Conditions

As noted earlier, although some hydrogenation occurs in the preheater, the major reaction occurs in the reactor. The reactor is operated at hydrogenation conditions which are sufficient to both hydrogenate the hydrocarbonaceous material and convert a catalyst precursor, if present, to its active form. In coal liquefaction, a minimum hydrogenation temperature of about 375° can be employed, although a typical minimum of about 430° C is preferred with a minimum of about 450° C more preferred. Slurry oil degradation and similar considerations are the limitations upon the maximum hydrogenation temperature but temperatures in excess of about 600° C are generally not employed. A maximum temperature of about 470° C most preferred. Reaction pressures, of course, depend upon reaction temperature, but a minimum reaction pressure of about 1,000 psig is typical, although a minimum of about 1,500 psig is preferred with a minimum of about 2,000 psig most preferred. A typical maximum reaction pressure is about 10,000 psig although a maximum of about 4,000 psig is preferred with a maximum of about 2,500 psig most preferred.

The conversion of the hydrocarbonaceous material, particularly coal, to asphaltenes and a low yield of hexane-soluble oil and gases is an easy, fast transformation which occurs well without a catalyst and at the lower temperatures and pressures. However, the conversion of asphaltenes and residual heavy oil (generally oil having a distillation temperature in excess of about 540° C) is considerably slower and kinetically more difficult, thus requiring the more preferred temperatures and pressures and presence of a catalyst. Moreover, sufficient residence time is provided in the presence of the catalyst to allow these more difficult reactions to proceed. The total residence time of the slurry within the preheater comprises generally less than about 3 percent of the total reaction time, i.e., the time from which the slurry enters the preheater to the time it exits the reactor. As regards reactor residence time, generally a maximum of about 50 pounds of hydrocarbonaceous material per cubic foot of reactor can be efficiently processed per residence hour but this figure can vary significantly depending upon the material, process equipment and conditions, etc.

Like the preheater, reactor design is not critical and can be varied to convenience. Typical reactors include both column and tubular, up-flow and tank, with and without an integral preheater, etc. An up-flow, column reactor without an integral preheater is generally preferred.

V. Reactor Product Separation Sequence

The hydrogenation or reactor product exiting the reactor is a three-phase gas, liquid and solid stream. Prior to this stream's introduction into a high pressure separator, it is generally cooled, usually by means of a heat exchanger. Typically, this high pressure separator removes unreacted hydrogen and light gases overhead and these are then further processed (not pictured within drawings) to separate the unreacted hydrogen from the light gases. This further processing generally includes separating unreacted hydrogen from light reactor product gases and recycling the former while recovering the latter. The remaining hydrogenation product or underflow from the high pressure separator is removed to a low pressure separator with an accompanying pressure reduction.

Within the low pressure separator, LPG's, water vapor and light oil are removed overhead, and introduced into a third separator, e.g., separator 23. Therein, the LPG's are recovered as an overflow and the light oil and aqueous product are recovered as an underflow.

VI. Gravitational Separation (Hydroclones)

The underflow from the low pressure separator contains essentially all of the ash, unreacted material, asphaltenes, most of the distillable oil (oil having a distillation temperature of greater than about 150° C) and the catalyst. This underflow (or reactor product oil or liquid hydrogenation product) is gravitationally separated into a first stream and a second stream, the first stream having both a lower ash concentration than the liquid hydrogenation product and a greater catalyst:ash ratio than the second stream, i.e., the first stream has a reduced ash concentration. At least a portion of the first stream is recycled to the slurry preparation zone for use as a slurry oil component (thereby recycling at least a portion of the catalyst) while the second stream is forwarded to an extractive separation (later described).

The selective separation of catalyst particles from particles of ash can be done by any convenient gravitational method. These methods include both conventional settling processes (where normal gravity is used to obtain a selective separation) and centrifugal concentration (where a centrifugal force is used to apply an enhanced artificial gravity to accelerate the selective settling of suspended solids). Because of the much shorter time required, some type of centrifugal separator is ordinarily preferred over a settling tank although where a particular material yields unusually coarse particles of ash and low viscosity oil, a settling tank type of operation can be practical. A continuously fed centrifugal separator, such as a hydroclone, is particularly preferred. Also in the interest of shorter process time, the liquid separation is preferably done at an elevated temperature to reduce the viscosity of the suspending or slurry oil medium and thus improve the efficiency of operation of the hydroclone. A temperature from ambient temperature to a temperature just below the oil decomposition temperature can be used. At the preferred higher temperatures the process is run under pressure to prevent extensive vaporization.

A gravity or centrifugal concentration can also be done in more than one stage or by using different types of gravity concentrator in multiple stages. Thus, a partial separation can be achieved in a first stage to obtain an upper oil layer containing suspended catalyst and a lower heavy layer still containing a substantial amount of oil with a significant quantity of suspended catalyst along with the concentrated ash particles, then subjecting the lower layer to a second concentration in a hydraulic centrifugal separator to produce a second upper oil layer containing suspended catalyst. In this way, a significant fraction of the catalyst originally present in the liquid hydrogenation process effluent can be recovered as active catalyst suspended in oil and suitable for recycle. By this process from about 20 percent to as high as about 90 percent of the catalyst can be recovered for recycle as particles suspended in the oil product and under preferred conditions about 50 to 80 percent of the catalyst can be recovered in this manner.

The size limits of catalyst particles operable in the present separation are relative to the average size of ash particles found in the particular material being hydrogenated and for efficient operation of this process, it is usual that the average size of the catalyst particles are smaller than the average size of the ash particles. Since the efficiency of a gravity-type separation of different sized suspended particles varies according to the square root of the ratio of their diameters, all other factors being equal, preferably the average diameter of ash particles is larger by a factor of at least about the square root of 2 ($\sqrt{2}$). In practice, ash particles remaining after the hydrogenation of some typical bituminous coals average at least 10 micorns in size. Under these conditions, the suspended catalyst particles in the hydrogenated slurry should average less than 10 microns in diameter and preferably about 7 microns or less for best results.

Factors other than particle size which affect settling rates include the densities of the particles and the liquid medium, the viscosity of the liquid medium, and the strength of the gravitational field. However, for a given product distribution most of these additional factors are fairly well fixed and affect the separation of the ash from the catalyst only in minor degree. For example, the recycle oil medium remains about the same and its viscosity and density under process conditions are reasonably constant Similarly, the density of the ash particles will not vary greatly. The density of the catalyst particles will vary somewhat, but not enough to significantly affect the separation procedure. Therefore, relative particle size remains the principal determining factor.

The hydroclones here used are generally operated at a temperature of less than about 400° C (with a maximum temperature as high as the pressure conditions and thermal stability of the second stream will allow). The hydroclone pressure drop, is as high as practical. the hydroclone split, i.e., the overflow/underflow weight ratio, is generally operated at a minium ratio of at least about 30:70 and at a maximum not in excess of about 90:10. The underflow from the second separator is fed to the hydroclone at whatever rate is obtained from the operation pressure. Preferably, the overflow/underflow split is adjusted so that the overflow is recycled to comprise about 75 percent of the slurry oil. As mentioned earlier, the hydroclone reduces the ash level but due to the fine disperion of the catalyst, the catalyst is not effectively separated. Therefore, the hydroclone overflow which comprises typically about 75 percent of the slurry oil stream contains catalyst concentrations essentially equal to that in the hydroclone feed. This catalyst recycle results in an increase in catalyst concentration in the reactor by a factor of about 2 over the catalyst added to the feed (assuming no change in the catalyst content of the feed). The catalyst recycle is further described in Applicant's copending application entitled "Coal Hydrogenation Catalyst Recycle", Ser. No. 772,873, filed Feb. 28, 1977.

VII. Extractive Separation (column 34)

The second stream from the gravitational separation (hydroclone underflow), which contains concentrated ash, is extractively separated into a third stream containing essentially no ash and a fourth stream containing essentially all of the ash of the second stream. "Extractively separated" means liquid-liquid solvent extraction. At least a portion of the third stream is recycled for use as at least a portion of the slurry oil and the fourth stream is generally forwarded to another process, such as gasification or pyrolysis. This second stream separation can be performed in a number of conventional manners, such contacting the stream with a promoter liquid in a mixing zone and then transferring the resulting liquid mixture to a gravity settling zone (U.S. Pat. Nos. 3,852,182 and 3,856,675), or with a solvent heated to above its critical temperature (U.S Pat. Nos. 3,607,716 and 3,607,717), etc. For reasons of operational efficiency, a preferred embodiment of this invention comprises separating the second stream into the third and fourth streams by countercurrent, liquid-liquid extraction within a vertical column or deasphalter. Although the physical features (housing and channel size and shape) of the vertical column here used can be varied to choice, the column is typically a hollow, elongated cylinder or pipe-like structure with a length over diameter (LOD) quotient between about 40 and 2 and preferably between about 20 and 5. The column can be made from any suitable material but materials, such as steel, known to perform well under elevated temperatures and pressures are preferred. A column generally comprises three zones: a first or solvent-extract mixture collection zone, a second or gradient separation zone, and a third or residuum collection zone.

The first zone is generally the top of the column and is equipped with a solvent-extract outlet. This zone collects the nonpolar solvent and extract flowing up the column for its ultimate removal from the column.

The second zone is generally the mid-portion, i.e., the portion between the first and third zones, of the column and is generally the largest (on an overall length basis) portion of the column. Within this zone, the second stream or column feed descends the column and continuously encounters nonpolar solvent of increasing purity. This gradient produces a more efficient extraction of that portion of the column feed which is soluble in the solvent and thus effects a more efficient extraction than would be possible in a single-stage back-mixed extractor. The second zone is generally equipped with a column feed inlet at or near its top and a nonpolar solvent inlet at or near its bottom. However, the feed inlet can be located in the bottom of the first zone and the solvent inlet in the top of the third zone.

The third zone is generally the bottom portion of the column (zone 46 of FIG. 3). This zone collects the residuum, i.e., fine solids and other materials comprising the feed not soluble in the non-polar solvents, for their ultimate removal from the column. This zone is generally operated at a higher temperature than the first and second zones because the residuum which is there collected has a greater viscosity than either the feed, extract or nonpolar solvent and thus requires a higher temperature to maintain its liquid state. The third zone is equipped with a residuum outlet which can be located at any convenient point thereon but is preferably located at the zone (and column) bottom. The column inlet and outlets here described are not pictured, per se, in the drawings but are located at the points where the respective conduits join with the column.

The ash particles are removed from the column feed by:

(a) contacting the feed with a nonpolar, liquid solvent, the contacting performed in a vertical column, the column operted at temperatures and pressures sufficient to maintain both the feed and solvent in the liquid state, the feed introduced into the column at or near the column top and the nonpolar solvent introduced into the column at or near the column bottom, the nonpolar solvent and feed contacted at a solvent:feed ratio of at least about 0.5:1 and contacted in such a manner that the nonpolar solvent:
  (1) passes up and through the column while the feed passes down and through the column;
  (2) is in intimate contact with the feed as they pass through the column; and
  (3) extracts from the feed as they pass through the column an extract comprising that portion of the feed soluble in a non-polar solvent at the column temperatures and pressures;
(b) recovering from the column as an overhead the nonpolar solvent and extract; and
(c) recovering from the column as an underflow a residuum comprising the ash particles.

This embodiment is characterized by an essentially quantitative removal of ash particles from the feed and a minimum amount of premium oil (extract) present in the underflow. Moreover, this embodiment, as do other embodiments, removes other materials, such as polar liquids (generally asphaltenes and toluene insolubles) and unconverted material.

The solids content (weight basis) of the column feed can vary widely but is at least partially dependent upon the polar liquids content. Generally, the more polar liquids present, the greater the solids content that can be effectively processed. Specifically, a sufficient quantity of polar liquids must be insoluble in the nonpolar solvent at column conditions such that the polar liquids coalesce to form a separate, liquid continuum in which the solids content can be dispersed. Although quantitative parameters can and will vary with the particular column feed, column conditions, solvent, etc., it can be generally said that the residuum should comprise less than about 65 weight percent solids. Consequently, a column feed comprising a solids content less than about 25 weight percent is preferred and a column feed comprising a solids content less than about 20 weight percent is more preferred.

The principal considerations in solvent selection are that the solvent selectively extracts the premium oil and that the solvent and premium oil (extract) not have significant overlap in their distillation ranges (since such overlap can result in cross-contamination). Since the components of the premium oil are generally nonpolar, a nonpolar solvent is used. The solvents are preferably hydrocarbon and more preferably $C_5$–$C_9$ aliphatic or alicyclic hydrocarbon, such as pentane, hexane, heptane, octane, 3-methylpentane, cyclopentane, cyclohexane, etc. Other suitable solvents include certain naphthenic or paraffinic portions of a coal liquefaction product, such as a mixed $C_4$–$C_5$ portion or a paraffinic petroleum portion. Solvents having higher distillation temperatures, such as decane or kerosene, can also be used if the 95 volume percent distillation temperature of the solvent is at least about 20° C less than the 5 volume percent distillation temperature of the column feed.

Column conditions (temperature and pressure) can and will vary with the solvent and the composition of the feed. A minimum column temperature is required sufficient to maintain the feed and residuum in the liquid state. The column temperature cannot exceed the critical temperature of the solvent. A minimum pressure is required sufficient to avoid vaporization of both the solvent and the feed. Practical considerations, such as equipment, economy, etc., are the only limitations upon the maximum pressure that can be employed.

Although column pressure is generally uniform throughout, column temperature generally varies from one area or zone of the column to another. This temperature variation is due to the relative viscosities of the various oils within the column and the large differences in their softening temperatures. Since the residuum is both relatively high in solids content and viscosity, it requires a greater temperature to remain liquid. Thus, the zone wherein this residuum collects (settles) is typically run at least about 25° C higher than the remainder of the column.

Although quantitative temperature and pressure ranges cannot be stated generically, by way of a coal liquefaction illustration and with hexane as the solvent, a typical minimum column temperature (excluding the residuum collection zone) is at least about 150° C and preferably about 170° C. Corresponding pressures are typically about 180 psi and about 200 psi. A typical maximum temperature is about 225° C and preferably about 200° C with corresponding pressures of about 400 psi and about 325 psi. The residuum collection zone temperatures are generally about 25° C higher respectively, with comparable pressures.

Ash particle removal from the product oil is at least partially dependent upon the solvent:feed weight ratio fed to the vertical column. A typical minimum weight ratio of about 0.5:1 can be used although a ratio of about 0.6:1 is preferred. Practical considerations, such as energy efficiency, are the only limitations upon the maximum weight ratio although a maximum weight ratio of about 5:1 and preferably of about 1:1 is typical. A weight ratio of about 0.8:1 is especially preferred. Generally, if the weight ratio is less than about 0.8, i.e., less than about 0.8:1, the recovered residuum has a reduced viscosity which indicates poor separation from the column feed. Moreover, detection of an interface between the residuum and the solvent-extract phases becomes difficult and the more difficult this becomes, the more difficult is the selective removal of the residuum from the vertical column. If the weight ratio is greater than about 0.8, feed throughput (volume per unit time) is sacrificed and additional costs and utilities are incurred. This countercurrent, liquid-liquid extraction is further described in Applicants' copending application entitled "Process for Removing Fine Solids from a Feed Slurry Produced by High Temperature Hydrogenation of a Solid, Hydrocarbonaceous Fuel", Ser. No. 809,958, filed June 27, 1977.

The recovered, high-solids content residuum or fourth stream is suitable as a gasification feedstock. The hydrogen:carbon ratio in this material is generally the same as or lower than that of liquefaction feed coal. Thus, if this material is used as fuel, expenditure of hydrogen is minimized. The third stream (deasphalted or premium oil) is a desirable recycle oil, a low-sulfur fuel or a feedstock for petrochemicals. This material is generally recovered as a bottoms stream from a solvent distillation unit. At least a portion of the extract is recycled as a slurry oil component and generally comprises about 25 weight percent of the slurry oil. The nonpolar solvent is readily separable from the premium oil and is generally recycled back to the vertical column.

VIII. Process Advantages

A. General

The sequential solids separations and resulting slurry oil generation, the hallmarks of this invention, afford overall process flexibility, stable process operation, ready response to changes in feed quality (particularly ash levels), and improved recovery after a process upset. By adjusting the proportions of the first and third streams (hydroclone overflow and deasphalter overflow), the viscosity and ash levels of the feed slurry can be readily reduced (or increased). This provides control over a possible, spiraling decrease in reactor product and slurry oil quality which can rapidly result in process inoperability. Moreover, the amount of slow converting components (toluene insolubles and asphaltenes) in the feed slurry can also be reduced (or increased) by adjusting the proportions of the first and third streams and this provides control over the ease of conversion for a large portion of feed.

B. Specific

The preferred embodiments of this invention have several distinct advantages over the processes of the prior art. A first advantage is the expendable catalyst. A conveniently and simply prepared catalyst precursor formulation (water emulsion) is dispersed in a slurry.

This slurry may then be either used immediately or may be held for periods of many hours with no loss of catalyst effectiveness. This method of preparation results in a very fine catalyst dispersion and this in turn eliminates the need of high circulation rates for maintaining good catalyst dispersion. Problems of irreversible catalyst settling (slumping) are nonexistent. Because of the flow-through design, the total residence time of the catalyst in the reactor averages only a few hours. Thus, aging effects (if present) are not apparent. Moreover, loss of catalyst activity and resulting changes in product viscosity, heteroatom content and asphaltene levels (all of which have a strong effect on the operability of H-Coal and Synthoil type processes) are nonexistent in this invention. This greatly simplifies process control.

Another result of the high catalyst dispersion and corresponding high catalyst activity is the extremely low level of catalyst necessary for good performance. The low levels of catalyst present at any given time in the reactor essentially eliminate the economic concern for the catalyst inventory which must be taken into account in a large-scale plant operation when process disruptions requiring emergency shutdowns are encountered. These low catalyst levels are also important to the cost effectiveness of an expendable catalyst.

Further advantages of this catalyst system are the avoidance of extensive down time for removal of spent catalyst followed by reloading and pretreating fresh catalyst. Problems of developing means for regenerating spent catalyst are wholly avoided and the need for spare reactor trains is greatly reduced.

A second advantage is the use of hydroclones. Hydroclones are probably the least expensive, most rugged solid separation devices available. Capable of operating reliably at elevated temperatures and pressure, they are energy and thermally efficient devices. Although hydroclones are limited in that they will not remove particles below a certain size, this limitation is utilized to an advantage in this process to achieve catalyst recycle. The hydroclone offers an additional advantage of allowing for a convenient control of the underflow/overflow split. As a result, fine adjustment of the process for changes in ash content or process feed are possible.

A third advantage is the use of countercurrent, liquid-liquid extraction to effect essentially complete solids removal from a liquefaction product oil. The deasphalter here used is ideally suited for coal liquefaction in that it provides a quality, fuel-grade product oil, and it effectively concentrates solids in a residue stream which may be handled as a viscous liquid. Moreover, the deasphalter will process ash-rich process streams such as hydroclone underflow. Furthermore, expendable catalyst is eventually quantitatively collected in the deasphalter residue stream and the active catalyst component can be effectively recovered for reprocessing if so desired.

The following examples are illustrative of certain, specific embodiments of this invention. Unless otherwise noted, all parts and percentages are by weight.

SPECIFIC EMBODIMENTS

I. Apparatus and Procedure

Pittsburgh No. 8 mine coal was crushed, dried at about 100° C in a vacuum oven, pulverized and classified to provide a 99.8+ percent −120 mesh coal. Pulverizing and classifying were done under an inert atmosphere and the pulverized coal was stored in sealed containers under nitrogen blanket until use.

A slurry was prepared by adding coal to recycle oil comprising 75 percent hydroclone overflow product and 25 percent deasphalted oil (both prepared as described below). A catalyst emulsion was prepared using the following amounts of material for each 100 pounds of coal:

0.1 pounds ammonium heptamolybdate tetrahydrate
1.5 pounds water
4.8 pounds emulsion oil The salt was dissolved in the water at room temperature. An emulsion was formed by adding the oil slowly to the aqueous solution while agitating with a high shear mixing device. Emulsion oil was either 150+° C coal-derived oil or preferably hydroclone overflow product obtained by hydrocloning this material. The catalyst preparation, as described, was added to 37.5 pounds deasphalted oil and 107.7 pounds hydroclone overhead. The resulting mixture was combined with 100 pounds of coal to produce a slurry of about 40 percent coal.

A slurry of the above composition was pumped to the inlet of a coil preheater where it was combined with hydrogen. Feed rates were 15 lb/hr of slurry and 205 cu ft/hr of gas (144 SCF of fresh hydrogen and the balance recycle gas). The slurry and gas were pumped through the preheater and upflowed through the reactor which had an internal volume of 7500 cu cm. The reactor outlet pressure was controlled at 2000 psig. Pressure drop through the preheater was about 300 psi.

After leaving the reactor, the products were cooled by heat exchange to a temperature between 100° and 125° C and then fed to a high pressure gas-liquid separator. The gases from the separator were scrubbed by direct contact with an aqueous solution and then either recycled or removed from the system by a back-pressure control valve. The aqueous solution (after pressure reduction) was recycled through a pump to the scrubber. The underflow from the high pressure separator was flashed to a 10 psi separator heated to 150° C. The liquid slurry phase of this separator was collected as 150+° C product. The vapor phase consisted of light oil, water vapor and flash gases passed through a water-cooled condenser and into another separator. The liquid phase was collected as net products for phase separation and analysis. The non-condensible gases were combined with a high pressure purge gas and the gases desorbed from the aqueous phase in a high pressure gas scrubber, reduced to 1 atmosphere of pressure, metered, sampled and scrubbed to remove $H_2S$ before being vented.

Feed and recovery rates for all components are recorded. Material balances were regularly determined around the system with a closure of about 96–100 percent.

The 150+° product (obtained as an underflow) was hydrocloned in a 10 mm i.d., Doxie Type A, Dorr-Oliver hydroclone. Conditions for the hydroclone operation were typically 205° C inlet temperature, 138 psig inlet pressure, 12.5 lb/minute feed, 19 psig outlet pressure (overflow) and a 55/45 overflow/underflow split.

All of the overflow product from the hydroclone was used as slurry oil. The underflow from the hydroclone was inventoried until the hydroclone overflow had been recycled four times and then the underflow was forwarded to the deasphalter. The deasphalter was a jacketed, vertical column (3 inches i.d., 54 inches length). The first and second zones were operated at a temperature of about 160° C and a pressure of about 200 psig and the third zone was operated at a temperature of about 200° C and a pressure of about 200 psig. The pressure in the column was controlled by a back pressure controller and a valve on the heated (150° C) solvent-extract outlet. This outlet fed into an adiabatic flash drum. There the solvent was flashed, removed and subsequently condensed and recycled to a solvent feed tank. Purified products from the flash drum were stripped of residual solvent (hexane) with a continuously refed distillation unit. Feed rates were approximately 45 pounds per hour of underflow and 36 pounds per hour of hexane. Underflow (asphaltenes) from the deasphalter was produced at 12 pounds per hour and contained virtually all of the ash fed to the system. The deasphalter overflow was flashed and then distilled to recover hexane for recycle. The bottoms from the hexane recovery still (deasphalted oil or extract) was partly used as the remaining 25 percent of the slurry oil. The balance was net product.

The recycle operation was run for 10 or more passes to assure that the system was at steady-state, i.e., all oil in the system had its origin at the specified operating conditions.

II. Analytical Procedures

In the following examples, the analytical procedures employed were as follows:

A. Viscosity

Viscosities of product liquids were measured at 25° C using a Brookfield Viscometer. Ash was not removed from these liquids prior to the measurement.

B. Toluene Insolubles

Product liquid (40 grams) was shaken with toluene (160 grams) and subsequently centrifuged. The supernatant liquid was decanted and the remaining residue, toluene-insoluble hydrocarbons and ash, was vacuum-dried at 100° C and weighed. The ash content of the residue was determined by ANASI/ASTM D482-74.

C. Asphaltenes

Product liquid (25 grams) was shaken with n-hexane (100 grams) and subsequently centrifuged. The supernatant liquid was decanted and the residue (a mixture of ash, toluene-insolubles and toluene-soluble hydrocarbons which are insoluble in n-hexane, i.e., asphaltenes) was vacuum-dried at 100° C and weighed. The asphaltene content was determined by subtracting toluene insolubles and ash previously determined from the total hexane-insolubles.

III. Data and Discussion

A. Various modes of solid separation and recycle oil generation were examined including the use of the hydroclone alone, the use of the deasphalter alone, and the combination of the deasphalter and hydroclone as described above. In each case the expendable catalyst system was employed. For each mode of operation prolonged runs were made to assure that true recycle operation was achieved and to evaluate steady-state operation, i.e., the overall product distribution was relatively constant over time.

In the deasphalter mode, the recycle oil was obtained from seven consecutive deasphalter runs each using as deasphalter feed 150+° C product oil from the preceding operating period. 282 Hours on stream were logged.

In the hydroclone mode, the initial slurry oil was deasphalted oil. Typically, two-thirds of the oil inventory in the system was processed during each 24-hour operating period. Four hydroclone mode runs were made totaling over 1,000 hours on stream. In the hydroclone mode, a high ash product oil (hydroclone underflow) was obtained as a net product. The ash level in the stream exceeded the solid level which would be effectively separated by a deasphalter and thus an alternate solid removal step would be required in place of or in addition to the deasphalter.

Combined modes runs were made totaling nearly 1,000 L hours on stream at two different levels of the expendable catalyst. The 150+° C product oil was hydrocloned 35 times during these runs. After every fourth hydroclone run, the combined hydroclone oil was deasphalted with a total of nine deasphalter runs being made. Material balances for runs in each of these three modes, along with the operating conditions, are presented in Table 1.

TABLE I

NET[1] MATERIAL BALANCES FOR VARIOUS OPERATIONAL MODES

| | Deasphalter | Hydroclone | Combined I | Combined II |
|---|---|---|---|---|
| Conditions | | | | |
| Temp. ° C | 460 | 460 | 460 | 460 |
| Pressure, psig | 2,000 | 2,000 | 2,000 | 2,000 |
| Slurry feed rate (coal lb/hr-ft$^3$) | 30 | 22.5 | 22.5 | 22.5 |
| Catalyst Concentration (Wt % $(NH_4)_6MO_7O_{24} \cdot 4H_2O$ based on coal) | 0.05 | 0.1 | 0.1 | 0.05 |
| Feed: lb | | | | |
| Coal (maf) | 100 | 100 | 100 | 100 |
| Ash | 12.8 | 13.3 | 13.5 | 19.4 |
| Hydrogen | 5.3 | 5.7 | 6.4 | 6.7 |
| Products: lb | | | | |
| SNG | 6.9 | 7.1 | 6.5 | 6.1 |
| CO, $CO_2$, $H_2S$ | 3.5 | 3.3 | 2.9 | 3.8 |
| LPG's | 12.8 | 15.0 | 13.1 | 13.3 |
| Light Oil | 8.4 | 9.5 | 12.0 | 11.3 |
| Aqueous | 6.6 | 8.6 | 7.3 | 9.3 |
| Deasphalted Oil | 34.4 | [75.5][2] | 43.7 | 35.5 |
| Residue | 45.5 | | 34.4 | 46.7 |
| Ash in Residue (wt. %) | 28.1 | 17.5 | 39.7 | 41.4 |

[1]Basis is 100 lb of moisture ash-free coal.
[2]Separation by solvent deasphalting not feasible due to low product quality.

The data of Table I demonstrates that the combined mode of operation gives lower yields of SNG, and residue and higher yields of light oil and deasphalted oil than either of the singular hydroclone or deasphalter modes. The ash level in the residue was also maximized in the combined mode. Moreover, prolonged steady-state recycle operation demonstrated that the same concentration of the catalyst added to the feed as in the cited deasphalter mode run made no significant change in product distribution with the exception of an increased yield of residue attributable to the higher level of ash in the feed slurry.

The efficacy of the expendable liquefaction catalyst was demonstrated conclusively by the final 200 hours of the combined mode operation. During this time period, all operations were continued except that no catalyst was added to the feed slurry. Due to catalyst recycle the catalyst level decreased by a factor of two for each successive slurry batch fed. The catalyst level was approximately 1/16 the normal level in the final batch processed. The effect on product yield on removing this catalyst was drastic. Product viscosity increased from about 500 cps to greater than 16,000 cps (measured at 25° C), light oil production decreased by a factor of 2, asphaltenes and toluene insolubles increased substantially. The run was terminated with no evidence for a stable steady-state condition being approached.

As noted before, the combined mode of operation provides for ready recovery of stable operation following a process disruption. When necessary, the amount of deasphalted oil used for slurry oil can be increased and the amount of hydroclone overflow decreased thereby reducing the viscosity and ash level of the slurry feed. This type of feedback permits control over a decrease in reactor product and slurry oil quality which can rapidly lead to system inoperability. Accordingly, it should be noted that the prolonged steady-state operation was not maintained in the hydroclone mode. A lack of means of control the quality of recycle oil led to an eventual loss of system operability in each test run. Temporary adjustments in the system operating parameters, such as catalyst level and slurry feed rate, were ineffective in restoring operability.

B. A typical chemical manufacturing complex requires petrochemical feed stocks for olefin and aromatics manufacture and large amounts of fuel. Part of the fuel is used for electrical power and steam generation and part is required for process heat generation. The high aromatic content of typical coal-derived naphthas make them a premium aromatic feed stock. The high normal to iso ratio found in $C_4$ and $C_5$ paraffins in the LPG fraction result in higher olefin yields than are obtained for typical petroleum LPG's. A comparison of the normalized product distributions between the product of this invention and other liquefaction processes is presented in Table II. For simplicity, the nonhydrocarbon products are omitted.

TABLE II

PRODUCT DISTRIBUTION COMPARISONS (lb/100 lb MAF[1] Coal)

| | INVENTION | H-COAL | SYNTH-OIL | SRC II |
|---|---|---|---|---|
| LPG's | 13.5 | 11.1 | 6.2 | 12.3 |
| NAPHTHA | 15.7 | 16.9 | 1.1 | 13.9 |
| TOTAL FEEDSTOCK | 29.2 | 28.0 | 7.3 | 26.2 |
| METHANE | 6.5 | 4.2 | 3.7 | 7.0 |
| DISTILLATE | 26.3 | 28.9 | 33.0 | 33.8 |
| FUEL OIL | 13.5 | 8.4 | 16.4 | — |
| TOTAL FUEL | 46.3 | 41.5 | 53.1 | 40.8 |

TABLE II-continued

PRODUCT DISTRIBUTION COMPARISONS (lb/100 lb MAF[1] Coal)

| | INVENTION | H-COAL | SYNTH-OIL | SRC II |
|---|---|---|---|---|
| RESIDUE | 20.9 | 22.0 | 32.2 | 26.5 |

[1]Moisture, Ash-Free

The Table II data demonstrates that the process of this invention is superior in feed stock manufacture and excellent in total fuel yield. The low level of residue also is an advantage in obtaining high flexibility in product use.

C. As indicated earlier, the limits on solids removal by hydroclones is utilized advantageously in this invention to achieve catalyst recycle. In Table III, data are presented on the effectiveness of the hydroclone in removing ash, iron and the active catalyst component from the liquefaction products boiling higher than 100° C.

TABLE III

HYDROCLONE PERFORMANCE AT STEADY-STATE DURING COMBINED MODE OPERATION

| | Separation Factor $\alpha$* |
|---|---|
| Ash | 2.0 |
| Iron (as pyrrhotite) | 2.8 |
| Catalyst | 1.0 |

$$*\alpha = \frac{\text{Concentration in Hydroclone Underflow}}{\text{Concentration in Hydroclone Overflow}}$$

The $\alpha$'s for ash and iron are generally greater than two for steady-state combined mode operation. Using Allison Mine Pittsburgh #8 coal, the $\alpha$ for the catalyst is about one, i.e., the catalyst concentration of the hydroclone overflow and underflow streams are essentially identical.

D. The deasphalter for this invention is a significant improvement over the existing processes in several respects. As noted earlier, the deasphalter uses a single, column-like vessel for the separation and operates on a continuous basis. By the use of countercurrent flows, a gradient in solvent concentration is obtained. This gradient serves an important role in obtainting a high yield of deasphalted oil and a concentrated ash residue. The mixer-settler type deasphalters described in the art provides single-stage extraction whereas in the present design, multiple-stage extraction is achieved by means of the concentration gradients in the column. Where multiple-stage extraction is required in the mixer-settler type deasphalters, multiple vessels and additional transfer pumps are required. Data on which to base a comparison of performances are lacking, however, that which is available indicates that the present design:

(A) requires shorter residence time to achieve essentially quantitative ash removal;
(B) is capable of handling feed streams with higher ash content;
(C) routinely delivers residue with a 40 percent ash content; and
(D) maximizes the yield of hydrocarbon oil and minimizes the coal fuel value which is accumulated in the residue.

The low volatile oil content in the underflow greatly reduces the need for additional oil recovery prior to downstream procedures, such as gasification. The data presented in Table IV, which includes for comparison purposes operations on feeds consisting of the hydroclone underflow, the straight coal liquefaction 150+°C product oil and a reduced ash centrifuge overflow, is indicative.

TABLE IV

SEPARATIONS EFFECTED IN A COUNTERCURRENT LIQUID-LIQUID DEASPHALTER

| | Hydroclone Underflow | 150+° C Liquefaction Product | Centrifuge Overflow |
|---|---|---|---|
| Feed Analysis | | | |
| Viscosity CPS at 25° C | 320 | 632 | 672 |
| Toluene Insolubles % | 9.8 | 11.8 | 9.1 |
| Asphaltenes % | 21.2 | 33.5 | 36.3 |
| Ash % | 12.4 | 5.02 | 1.9 |
| Wt. Fed | 517.5 lb. | 4,066 lb. | — |
| Deasphalted Product Oil Analysis | | | |
| Wt. % of Total Product | 73.3 | 81.7 | 88.3 |
| Viscosity CPS at 25° C | 60 | 152.0 | 83.0 |
| Toluene Insolubles % | 0.84 | 3.1 | 2.4 |
| Asphaltenes % | 18.6 | 29.9 | 28.8 |
| Ash % | 0.33 | .12 | .09 |
| Ramsbottom Carbon % | 11.1 | — | — |
| Asphaltene Analysis | | | |
| Wt. % of Total Products | 26.7 | 18.3 | 11.7 |
| Ash % | 41.2 | 28.1 | 17.7 |
| Carbon Wt. % | 48.9 | 61.6 | 72.0 |
| Hydrogen Wt. % | 3.2 | 4.0 | 4.2 |
| Sulfur Wt. % | 4.1 | 2.9 | 1.7 |
| $\Delta H_C$ BTU/lb. | 9,078 | 10,900 | 13,200 |
| Ramsbottom Carbon Wt. % | 72.7 | — | 74 |
| Run Accountability (wt. %) | 97.0 | 96.8 | ~95 |

These data demonstrate, over a wide range of solid-containing slurries, low residual of ash in the column overflow and a low residual of hexane-soluble hydrocarbon in the residual slurry.

Although the invention has been described in considerable detail through the preceding specific embodiments, particularly coal liquefaction, it is to be understood that these embodiments are only for purposes of illustration. Many variations and modifications can be made by one skilled in the art without departing from the spirit and scope of the invention.

What is claimed is:

1. A process for the conversion of a solid, hydrocarbonaceous material to valuable liquid and gaseous products, the process comprising:

(a) preparing a slurry from a slurry oil, a hydrogenation catalyst and the hydrocarbonaceous material;

(b) admixing hydrogen with the slurry;

(c) hydrogenating the hydrocarbonaceous material to liquid and gaseous hydrogenation products, the liquid hydrogenation product containing suspended particles of ash and hydrogenation catalyst;

(d) gravitationally separating the liquid hydrogenation product into a first stream and a second stream, the first stream having both a lower ash concentration than the liquid hydrogenation product and a greater catalyst:ash ratio than the second stream;

(e) recycling at least a portion of the first stream for use as at least a portion of the slurry oil in the slurry preparation and thereby recycling at least a portion of the catalyst;

(f) extractively separating with a solvent the second stream into a third stream and a fourth stream, the third stream containing essentially no ash and the fourth stream containing essentially all of the ash of the second stream;

(g) recycling at least a portion of the third stream for use as at least a portion of the slurry oil in the slurry preparation; and (h) recovering valuable liquid and gaseous products from the hydrogenation products.

2. The process of claim 1 wherein the solid, hydrocarbonaceous material is coal.

3. The process of claim 2 wherein the second stream is separated into the third and fourth streams by countercurrent, liquid-liquid extraction comprising contacting the second stream with a nonpolar, liquid solvent in a vertical column such that the third stream comprising the nonpolar solvent and an extract comprising that portion of the second stream soluble in the nonpolar solvent at the column operating conditions is removed from the column as an overflow and the fourth stream containing essentially all of the ash particles of the second stream is removed from the column as an underflow.

4. The process of claim 2 wherein the liquid hydrogenation product is separated into the first and second streams by centrifugal concentration.

5. The process of claim 4 wherein the second stream is separated into the third and fourth streams by countercurrent, liquid-liquid extraction comprising contacting the second stream with a nonpolar, liquid solvent in a vertical column such that the third stream comprising the nonpolar solvent and an extract comprising that portion of the second stream soluble in the nonpolar solvent at the column operating conditions is removed from the column as an overflow and the fourth stream containing essentially all of the ash particles of the second stream is removed from the column as an underflow.

6. The process of claim 2 wherein the hydrogenation catalyst of the slurry is formed in situ from a water emulsion of a metal-containing compound, the compound being dispersed among the other components of the slurry and being convertible to the hydrogenation catalyst under hydrogenation conditions.

7. The process of claim 6 wherein the liquid hydrogenation product is separated into the first and second streams by centrifugal concentration.

8. The process of claim 6 wherein the second stream is separated into the third and fourth streams by countercurrent, liquid-liquid extraction comprising contacting the second stream with a nonpolar, liquid solvent in a vertical column such that the third stream comprising the nonpolar solvent and an extract comprising that portion of the second stream soluble in the nonpolar solvent at the column operating conditions is removed from the column as an overflow and the fourth stream containing essentially all of the ash particles of the second stream is removed from the column as an underflow.

9. The process of claim 8 wherein the liquid hydrogenation product is separated into the first and second streams by centrifugal concentration.

* * * * *